United States Patent [19]

Slavik

[11] 4,112,915

[45] Sep. 12, 1978

[54] FIREPLACE ENCLOSURE WITH HEAT EXCHANGER

[76] Inventor: John W. Slavik, 5275 Mahoning NW., Warren, Ohio 44485

[21] Appl. No.: 786,409

[22] Filed: Apr. 11, 1977

[51] Int. Cl.[2] ..... F24B 7/00

[52] U.S. Cl. ..... 126/121

[58] Field of Search ..... 126/121, 138, 140, 202; D7/206, 208

[56] References Cited

U.S. PATENT DOCUMENTS

| | | | |
|---|---|---|---|
| 1,322,626 | 11/1919 | Sanford | 126/121 |
| 2,359,197 | 9/1944 | Brooks | 126/121 |
| 3,368,545 | 2/1968 | Ibbitson | 126/121 |
| 3,459,173 | 8/1969 | Lydle | 126/202 |
| 3,930,491 | 1/1976 | Miller | 126/121 |
| 4,050,441 | 9/1977 | Horwinski | 126/121 |

FOREIGN PATENT DOCUMENTS

| | | | |
|---|---|---|---|
| 483,076 | 3/1917 | France | 126/121 |

*Primary Examiner*—Carlton R. Croyle
*Assistant Examiner*—Michael Koczo, Jr.
*Attorney, Agent, or Firm*—Michael Williams

[57] ABSTRACT

A fireplace enclosure with glass doors to prevent heat loss from the room in which the fireplace is located, the enclosure having heat exchanging means connected to its frame structure so that the enclosure and heat exchanging means becomes a free-standing unit that may be installed in position with respect to a fireplace opening in a manner such as that heretofore used in installing the enclosure alone.

18 Claims, 14 Drawing Figures

FIG. 1.
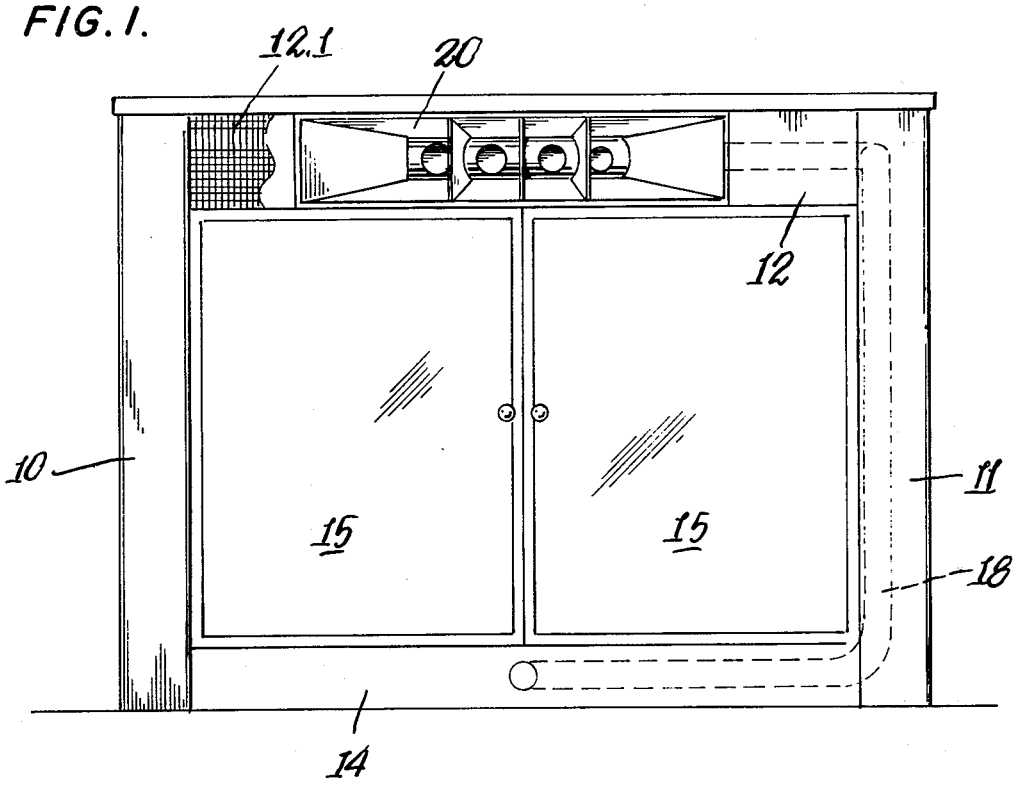
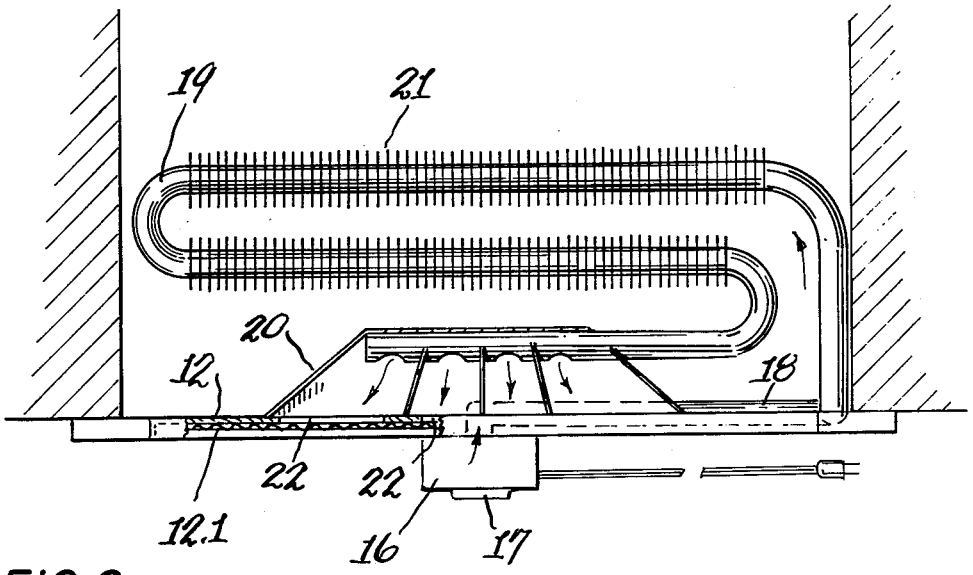
FIG. 2.

FIG.3.
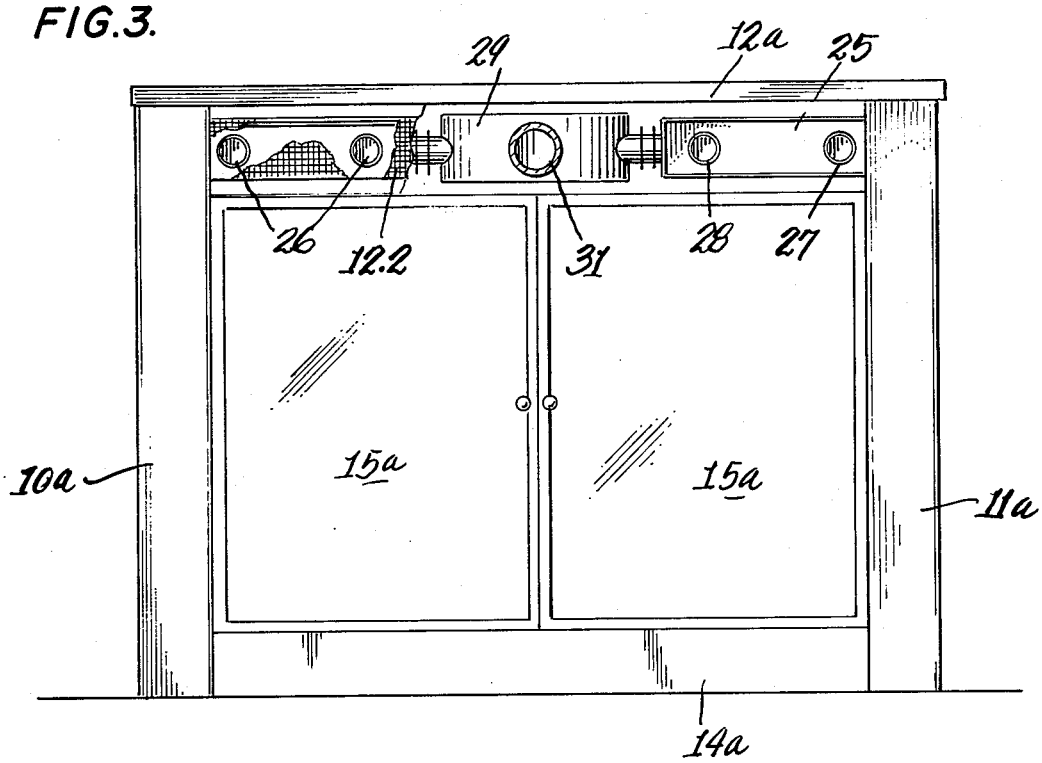
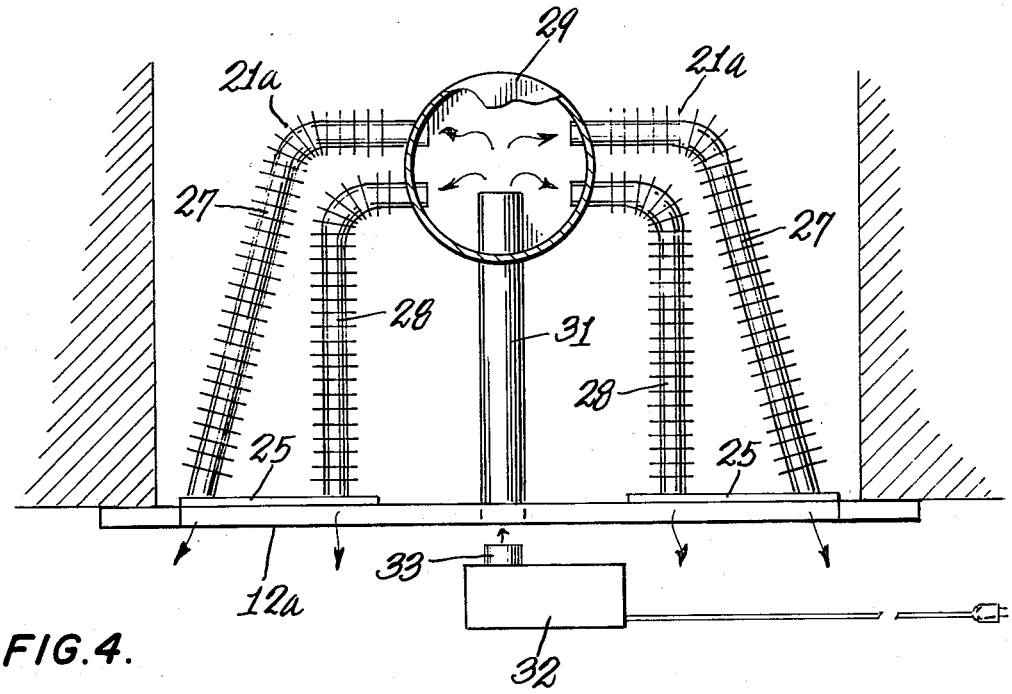
FIG.4.

FIG.5.
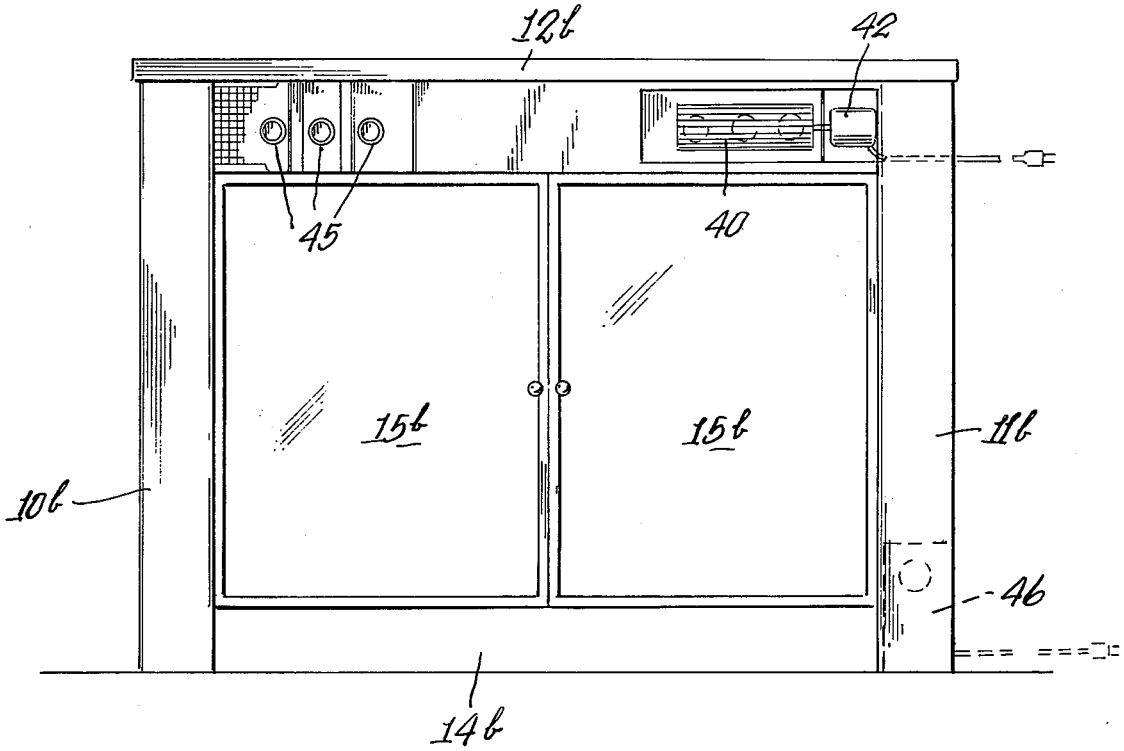
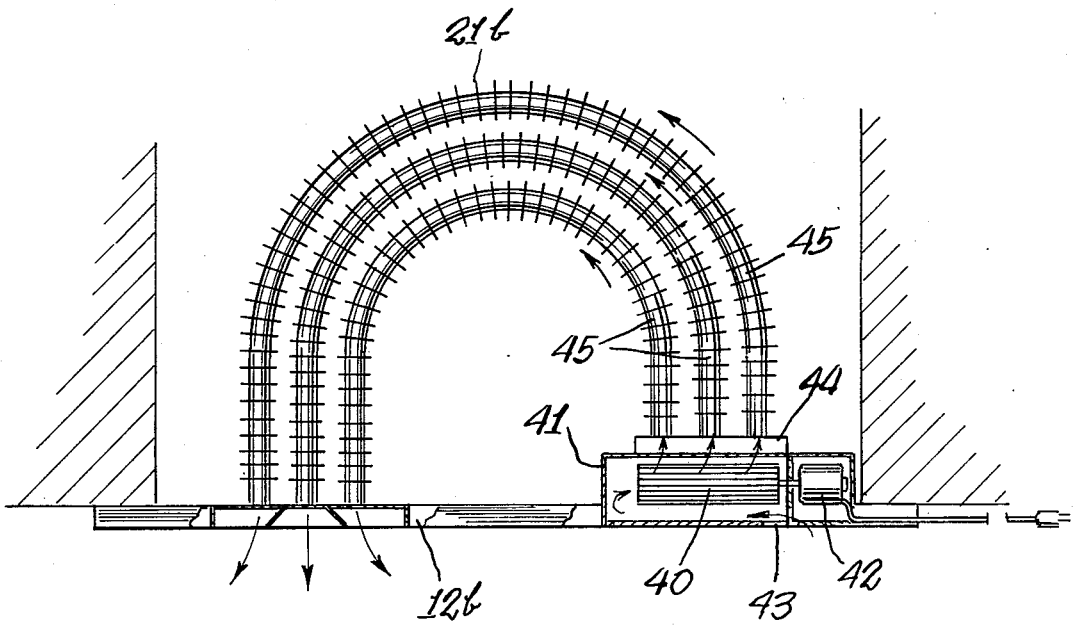
FIG.6.

FIG.7.
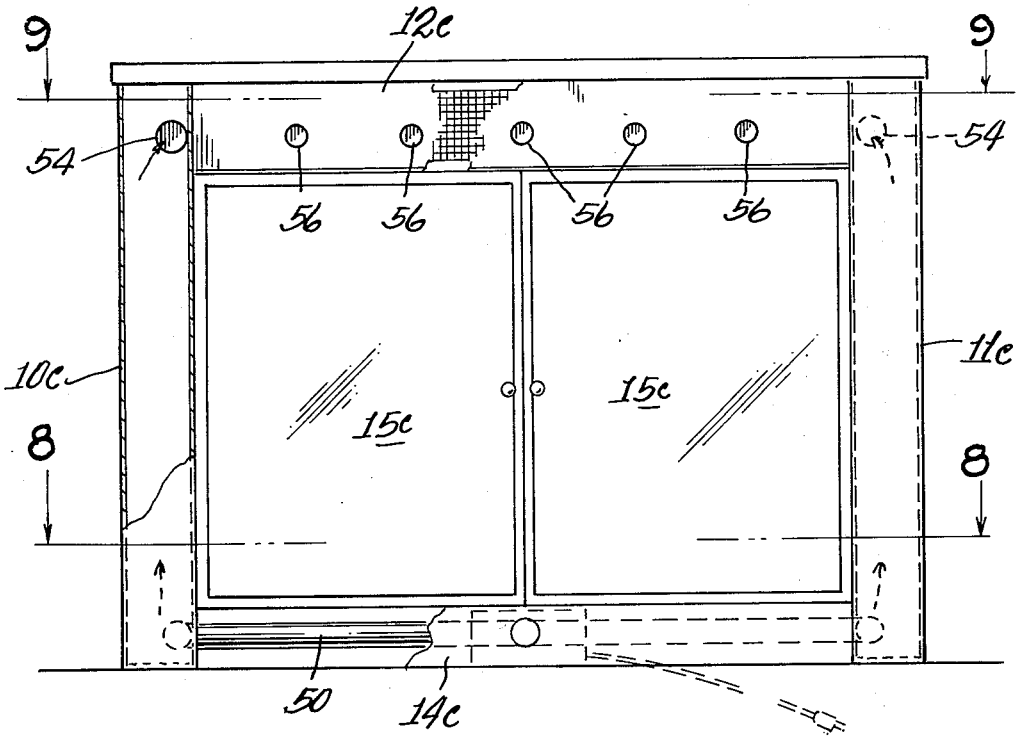
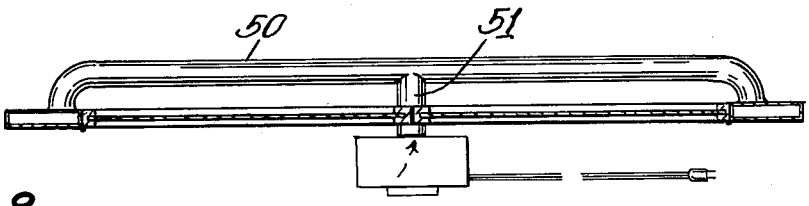
FIG.8.
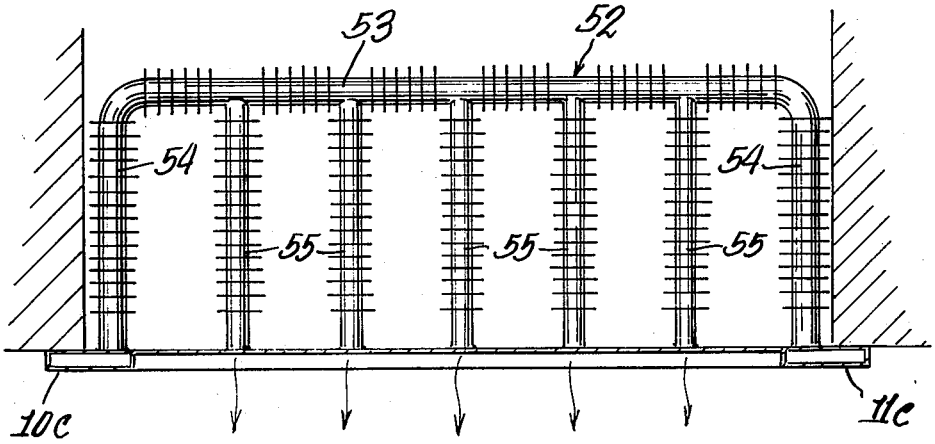
FIG.9.

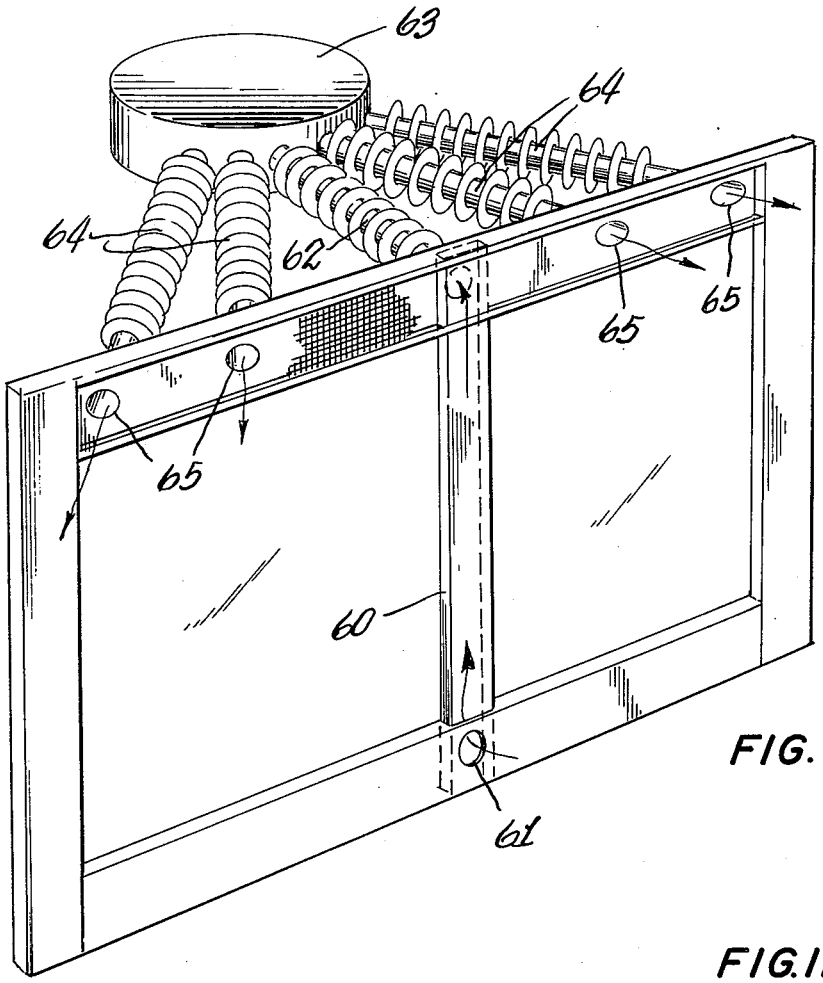
FIG. 10.
FIG. 11.
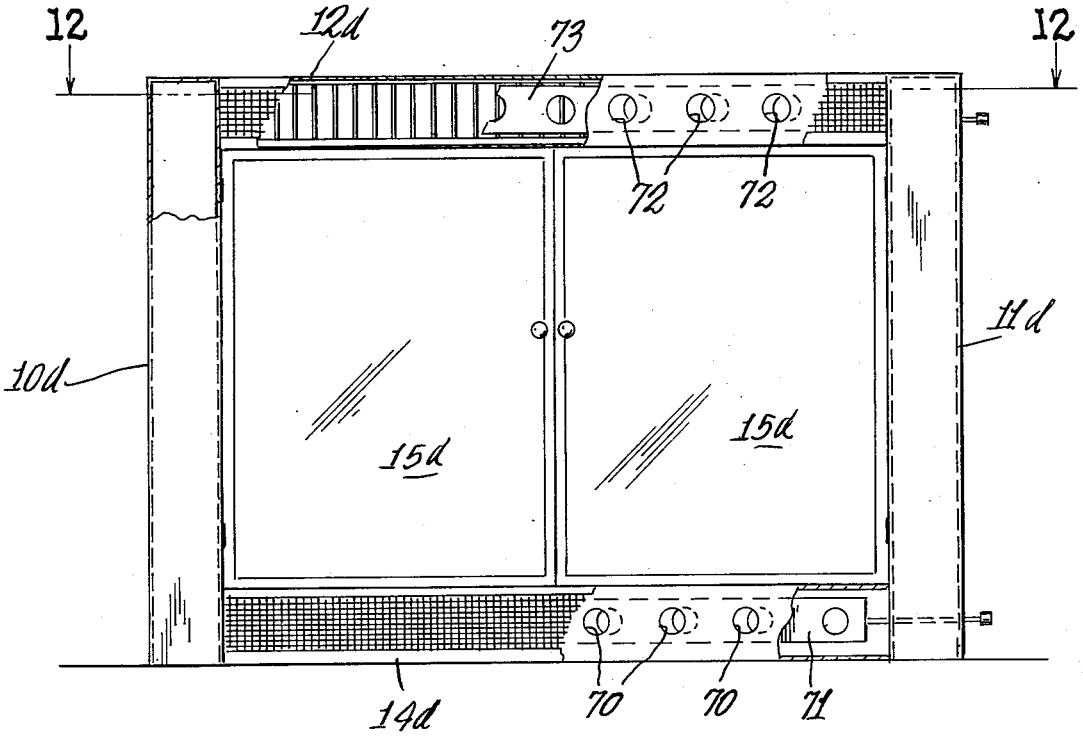

FIREPLACE ENCLOSURE WITH HEAT EXCHANGER

BACKGROUND AND SUMMARY

Fireplaces have been used as a source of heat as early as the primative days, and especially before the advent of heating stoves and later the central heating system. Originally, these fireplaces were open and unprotected and were fire hazards. Later, wire screens were produced to cover the fireplace opening and these afforded some protection against embers escaping from the fireplace. However, open fireplaces and those protected by a wire screen, are extremely inefficient as sources for heating a room, since most of the heat is vented through the chimney.

Thereafter, fireplace enclosures with glass doors or panels were developed to prevent heat from the area to be heated from being vented through the chimney, and the room was heated by radiation from the glass. This also solved the problem of embers escaping from the fireplace, and efficiency was slightly improved.

U.S. Pat. No. 3,870,032, issued Mar. 11, 1975, to Lydie et al., discloses a fireplace enclosure with glass doors and in addition discloses decorative apertured panels at the bottom and top of the enclosure to provide air openings into the fireplace.

With the advent of the energy shortage many attempts were made to increase the efficiency of the fireplace closure by installing heat exchange devices within the fireplace, including means to pick up heat from the fire and expell the heated air to the room.

U.S. Pat. No. 3,955,553, issued May 11, 1976, to Soeffker, discloses a heat exchanger which is placed within an existing fireplace and comprises a manifold exteriorly of the fireplace and connected to a forced air blower. A plurality of upright tubes have their lower ends connected to the manifold and have their intermediate portions disposed below, to the rear of and then extending forwardly of the fireplace grate, the upper ends of the tubes being open so that forced, heated air is returned to the room. This was a good solution to the energy-loss problem and increased efficiency of the fireplace to a marked degree.

However, some problems still existed in the Soeffker patent construction, and others like it, in that the heat exchanger was built into the fireplace and was separate from the fireplace enclosure and this required that the enclosure be tailor-made for the heat exchanger. My invention overcomes this problem by providing a heat exchanger as a unitary part of the fireplace enclosure so that the combination may be disposed to cover the fireplace opening in the simple manner required for enclosures either of the wire screen or glass door type.

DESCRIPTION OF THE DRAWINGS

In the drawings accompanying this specification and forming a part of this application, there are shown, for purpose of illustration, several embodiments which my invention may assume, and in these drawings:

FIG. 1 is a front elevational view of a fireplace enclosure showing one embodiment of my invention, FIG. 2 is a top view of such embodiment, parts being broken to show interior construction, FIG. 3 is a front elevational view of another embodiment of my invention, FIG. 4 is a top view of such embodiment, parts being broken to show interior construction, FIG. 5 is a front elevational view of still another embodiment of my invention, FIG. 6 is a top view of such embodiment, parts being broken to show interior construction, FIG. 7 is a front elevational view of a further embodiment of my invention, FIG. 8 is a sectional view corresponding to the line 8—8 of FIG. 7, FIG. 9 is a sectional view corresponding to the line 9—9 of FIG. 7, FIG. 10 is a perspective view of yet another embodiment of my invention, FIGS. 11 through 13 disclose yet another embodiment of my invention.

DESCRIPTION OF THE PREFERRED EMBODIMENT

Figure 12:
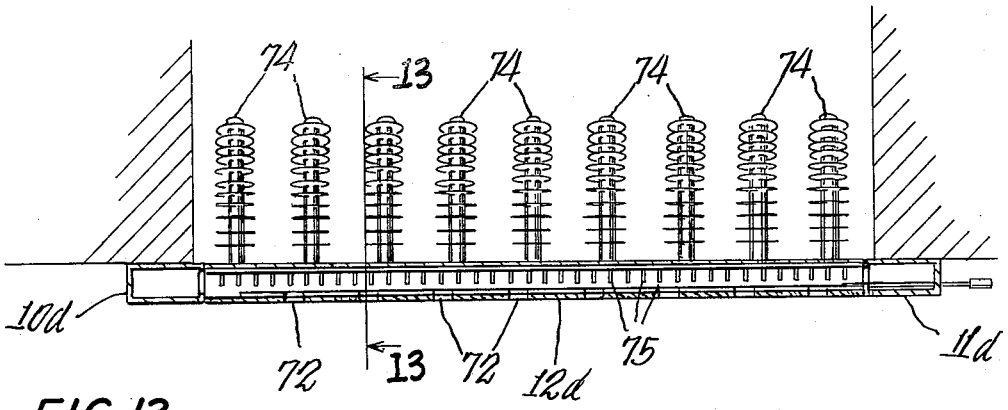

Referring to FIGS. 1 and 2, the fireplace enclosure may be of any suitable form such, for example, as that illustrated in the aforementioned Lydie et al patent. Spaced vertical side members 10 and 11 are rigidly joined to top and bottom members 12 and 14 to form a self-supporting, free-standing rectangular frame. A pair of glass doors 15 are hinged to the vertical members 10 and 11 to provide access to the fireplace.

An air blower housing 16 is connected to the bottom member 14, preferably in the center thereof for purposes of symetrical appearance, although the housing may be connected to the enclosure at any other suitable location. An electric motor 17 drives the blower to draw cool air from the floor area of the room and to discharge this air through a conduit 18, which extends upwardly within, or behind, the vertical side member 11.

The upper end of the conduit 18 is connected to one end of a generally horizontally disposed conduit 19 which is preferably shaped to serpentine formation as shown in FIG. 2. The other end of the conduit 19 is connected to and disposed within a manifold 20 which is horizontally elongated and is disposed behind the top member 12 to provide a horizontally elongated air chamber into which the air forced through the conduit 19 discharges. The conduit 19 is provided with heat absorbing fins 21 throughout the greater portion of its length.

Installation of the combination of the fireplace enclosure and heat exchanger is as simple as the installation of the known fireplace screens, in that it is only necessary to move the combination into position wherein it covers the fireplace opening. In its installed position, the conduit 19 overlies the fire in the fireplace, and it and the attached fins 21 accumulate heat of the fire. With the electric motor 17 connected to a source of current, air is drawn from the lower area of the room, is heated by passage through the conduit 19, and is discharged through the manifold and to the room through spaced openings 22 in the front wall of the top frame member 12. A damper (not shown but which may be of the type shown in the Lydie et al. patent) may be provided to selectively close the openings 22. Also, the top member 12 may have its front wall formed with a decorative grill or screen 12.1.

DESCRIPTION OF OTHER EMBODIMENTS

Referring to FIGS. 3 and 4, the rectangular frame of the fireplace enclosure may be similar to that hereinbefore described, and similar parts will be designated by similar members with the suffix "*a*" added. The top cross member 12*a* has a pair of shallow manifolds 25 attached to the rear thereof, each manifold communicating with a pair of openings 26 formed in the front wall of the member 12*a*. Again a decorative grill 12.2 may cover the openings 26.

Communicating with each manifold 25 are the ends of conduits 27,28, the other ends of such conduits communicating with the interior of a common manifold 29. The conduits 27,28 are provided with heat absorbing fins 21*a*. Extending into the manifold 29 is one end of an air inlet conduit 31. The opposite end of the conduit 31 extends forwardly and through the front wall of the top cross member 12*a*. A motor-blower unit 32 has an air outlet tube 33 which is adapted to fit closely within the open end of the conduit 31. If necessary, some suitable connection (not shown) may be provided to further detachably hold the motor-blower unit 32 to the top cross member 12*a*.

The embodiment shown in FIGS. 3 and 4 also provides a free standing unit that need only be positioned to close the opening into the fireplace. In such position, the conduits 27 and 28, and the manifold 29 are disposed above the fire in the fireplace, to heat the air forced therethrough by the motor-blower unit 32.

Referring to FIGS. 5 and 6, the embodiment therein disclosed again comprises a rectangular frame of the type hereinbefore disclosed, and similar parts will be designated by the same reference numerals with the suffix "*b*" added.

In this embodiment, a squirrel-cage blower 40 is mounted within a casing 41 which is connected to the rear side of the front wall of top cross member 12*b*. An electric motor 42 is disposed within a heat-proof casing and has drive connection with the blower 40. The casing 41 has an opening 43 through which air from the room is drawn. A shallow manifold 44 is formed at the rear of the casing 41 and a plurality of conduits 45 (three herein shown) have one end connected to the manifold and communicating with the interior thereof.

The conduits 45 extend rearwardly and have curved intermediate portions and then extend forwardly to connect with the rear side of the front wall of top cross member 12*a*, and such front wall has openings to permit heated air from the conduits to be blown into the room. The conduits are provided with fins 21*b* to transmit heat from the fire to the conduits which in turn transmit the heat to the air flowing through the conduits. If desired, the casings 41 and 42 for the blower and motor may be located behind the lower end of one of the side members, such as the location shown in dotted lines at 46 in FIG. 5.

Referring to the embodiment disclosed in FIGS. 7, 8, and 9, the usual rectangular frame is provided, and similar parts are given the same reference numbers with the suffix "*c*" added. A horizontal conduit 50 is secured in position behind the lower cross members 14*c* and has a central stub 51 projecting through an opening in such cross member, so that a motor-blower unit (such as shown at 34 in FIGS. 3 and 4) may be connected thereto. The side members 10*c* and 11*c* are formed as box sections and opposite ends of the conduit 50 are connected to the lower end of the rear wall of the members 10*c* and 11*c* and communicate with the interior thereof. A conduit 52 is disposed at the rear of the top cross member 12*c* and has an intermediate portion 53 spaced from the cross member and angled legs 54—54 extending forwardly. The end of each leg is connected to an upper portion of a respective side member 10*c*, 11*c* and in communication with the interior thereof.

Branch conduits 55 extend between the intermediate portion 53 of the conduit 52 and the upper member 12*c* to establish communication between the conduit intermediate portion 53 and air-outlet openings 56 in the member 12*c*. It should be understood that the lower cross member 14*c* may also be of a box cross-section so that its interior may be used to convey air from the blower to the interior of the side members 10*c* and 11*c*, to thus eliminate need for the separate conduit 50.

For installation, the rectangular frame of the embodiment shown in FIGS. 7, 8, and 9 need only be positioned to close the opening into the fireplace and in such position, the finned conduits 53, 54 and 55 are disposed in position above the fire. Air from the lower part of the room is drawn in by the blower and forced through the conduit 50, (or the box section of lower member 14*c*), through the box sections of side members 10*c* and 11*c*, into opposite ends of the conduit 52, through branch conduits 55, and into the room through outlet openings 56.

Referring to the embodiment shown in FIG. 10, the rectangular frame has a central upright member 60 of box section which has its opposite ends closed. An opening 61 is provided in the lower cross member in communication with the interior of the member 60, so that a blower unit may be plugged therein. A conduit 62 has one end connected to the upper end of member 60 and in communication with the interior thereof. The opposite end of the conduit 62 communicates with the interior of a manifold 63. Branch conduits 64 extend from the manifold 63 and communicate with openings 65 in the front wall of top cross member. In operation, air from the lower part of the room is drawn in by the blower and forced upwardly through the box section 60 and through the conduit 62 into the manifold 63, from where the heated air is forced through finned branch conduits 64 and through openings 65 to return to the room.

Figure 13:
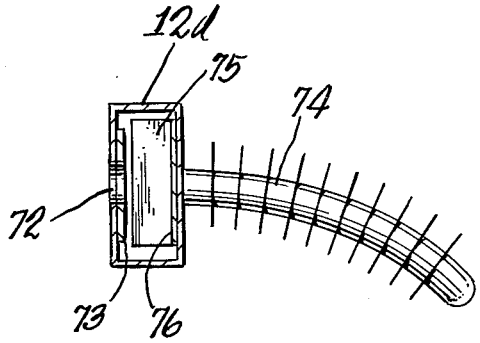

Referring to FIGS. 11, 12 and 13, the usual rectangular frame is provided, and in this case, the side members 10*d*, 11*d* and the top and bottom cross members 12*d* and 14*d* are all of box cross-section. Opposite ends of the bottom member 14*d* are open and in communication with the interior of respective side members 10*d*, 11*d*. The front wall of the bottom member 14*d* is provided with openings 70 for the admission of air from the lower part of the room. A slide damper 71 is adapted to control flow of air through the openings 70. Opposite ends of the top member 12*d* are open and in communication with the interior of respective side members 10*d* and 11*d*. The front wall of the top member 14*d* is provided with openings 72 for the return of heated air to the room. A slide damper 73 is adapted to control flow of air through the openings 72.

A plurality of finned heat-conducting tubes 74 are connected to the rear wall of the upper cross member 14*d*, but do not communicate with the interior thereof. A plurality of fins 75 are carried by a plate 76 which lies against the inside surface of the rear wall of a member 14*d* in good heat-conducting relationship therewith.

The embodiment shown in FIGS. 11 through 13 does not include a blower unit. However, since the tubes 74 are disposed over the fire, the upper cross member 12*d* has a higher temperature than the lower cross member 14*d*, and the air from the room is drawn by convection through the lower openings 70, upwardly through the side members 10*d* and 11*d*, into the upper cross member 12*d*, and returned to the room in heated condition through the top openings 72.

Figure 14:
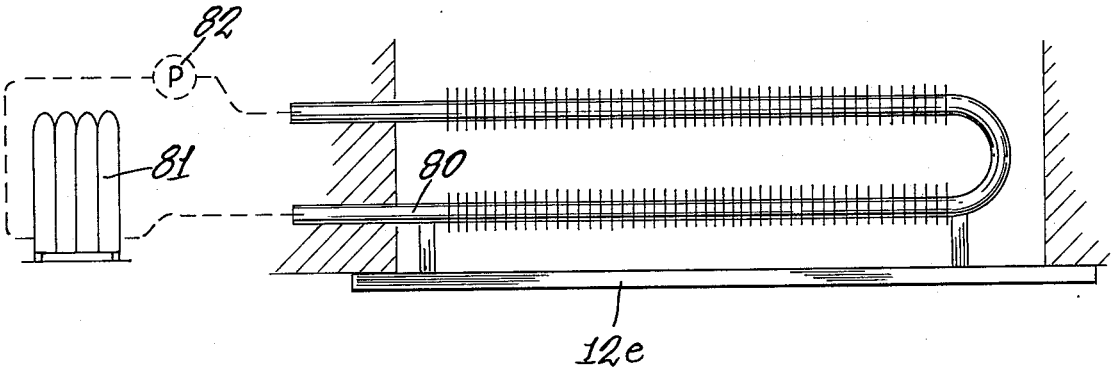
FIG. 14 is a somewhat schematic representation of another embodiment of my invention.

With respect to FIG. 14, the view corresponds somewhat to the top plan view of FIG. 2, and discloses the top cross member 12*e* of the rectangular frame. A finned conduit 80 is supported from the rear of member 12*e* and is adapted to contain water. Opposite ends of the conduit 80 are schematically shown as connected to the inlet and outlet of a radiator 81 which may be disposed adjacent to the fireplace or carried by the rectangular frame. A water pump 82 may be provided to circulate the water.

I claim:

1. A unitary structure for use with a fireplace, comprising:

a flat metal frame that has an outline greater than the opening of a fireplace and adapted to be positioned flatwise of and in abutment with surfaces bordering the fireplace opening, said frame defining a fire view opening therethrough, glass door means for spanning and closing said frame opening and preventing any substantial amount of heated air and products of combustion from the fire in said fireplace to flow through said frame opening and into the room in which said fireplace is located, said door means being movably mounted on said frame for movement to uncover said frame opening and thereby provide access to the fire in said fireplace, an air heating device unitarily connected to said frame for bodily movement therewith, including heat exchange conduit means extending rearwardly from the upper portion of said frame and substantially concealed therebehind, air inlet means connected to said conduit means and extending forwardly through said frame and adapted to receive cool air from said room, and air outlet means connected to said conduit means and extending forwardly through said frame for expelling heated air into said room, said air heating device being disposed in operative position within said fireplace in unobstructing relation to the area rearwardly of said glass door means to provide full view and enjoyment of the fire with said conduit means above the fire when said frame is positioned flatwise of and in abutment with said surfaces bordering said fireplace opening.

2. The construction according to claim 1 wherein said heat exchange conduit is in the form of a tube having a serpentine formation.

3. The construction according to claim 1 wherein said air outlet means is in the form of a manifold connected to said upper frame portion, an end of said heat exchange conduit extending into said manifold and having a plurality of air outlet openings, said frame upper portion having laterally spaced openings in number equal to said air outlet openings, and a plurality of vanes within said manifold, each for directing heated air from an air outlet opening to a respective opening in said frame upper portion.

4. The construction according to claim 2 wherein said tube is provided with heat accumulating fins, and wherein said air inlet means is at a lower portion of said frame to receive air from adjacent to the floor of said room.

5. The construction according to claim 1 wherein said air inlet means communicates with the interior of a manifold, and wherein said heat exchange conduit means comprises a plurality of tubes, each having one end communicating with the interior of said manifold and an opposite end communicating with said air outlet means.

6. The construction according to claim 5 wherein said air inlet means comprises a tube having one end communicating with an opening in said frame upper portion and an opposite end communicating with the interior of said manifold.

7. The construction according to claim 1 further including blower means cooperatively associated with said conduit means for drawing cool air into said inlet means and forcing heated air out of said outlet means.

8. The construction according to claim 6 further including blower means having a blower casing provided with an outlet stub fitting in detachable manner within said frame opening which communicates with said one end of said air inlet tube.

9. The construction according to claim 1 wherein said heat exchange conduit means comprises a tube having one end communicating with said air inlet means and the opposite end communicating with said air outlet means, the intermediate portion of said tube extending rearwardly from the upper portion of said frame.

10. The construction according to claim 9 wherein said intermediate tube portion is curvilinear.

11. The construction according to claim 9 wherein said air inlet means comprises the inlet to the casing of a blower, and wherein said one tube end communicates with the outlet of said casing.

12. The construction according to claim 1 wherein said heat exchange conduit means comprises a plurality of nested tubes, and wherein said air inlet means comprises an inlet to the casing of a blower means, each of said nested tubes having one end communicating with the outlet of said blower means casing, and each of said nested tubes having its opposite end communicating with said air outlet means, the intermediate portion of each of said nested tubes being curvilinear.

13. The construction according to claim 1 wherein said heat exchange conduit means comprises a tube of U-shape, each leg of said tube communicating with said air inlet means and the intermediate portion of said tube communicating with said air outlet means.

14. The construction according to claim 1 wherein said frame comprises tubular upper and lower members and laterally spaced upright tubular side members, the interior of said lower and side members being in communication, said air inlet means comprising an opening in said frame lower member whereby inlet air may flow through the latter and upwardly through said side members, and wherein said heat exchange conduit means comprises a tube of U-shape, the legs of said tube communicating with the interior of respective side members at the upper end of the latter whereby inlet air may flow through each of said legs and to the intermediate portion of said tube, and a plurality of laterally spaced stub tubes, each having an end in communication with the interior of said tube intermediate portion and an opposite end in communication with the interior of said upper frame member, the latter having laterally spaced forward facing openings in number equal to said stub tubes and in communication with the same, whereby heated air may be expelled through said forward facing openings and into said room.

15. The construction according to claim 1 wherein said frame comprises upper and lower members, laterally spaced upright side members, and an upright tubular member intermediate said side members, said intermediate upright tubular member comprising said air inlet means and having an opening in a lower end for inlet air, and an outlet opening at an upper end, a tube having one end in communication with said outlet opening and an opposite end in communication with the interior of a manifold, a plurality of side tubes, each having one end in communication with the interior of said manifold and an opposite end in communication with a forwardly facing opening in said upper member of said frame, to provide expelling heated air into said room.

16. The construction according to claim 1 wherein said heat exchange conduit means comprises a plurality of finned tubes extending rearwardly of said frame upper portion and connected to said air inlet means, said air inlet means including passages extending downwardly along the sides of said frame therebehind communicating with a passage along the bottom of said frame therebehind, said last-named passage including portions extending forwardly through said frame to receive said cool air.

17. The construction according to claim 16 further including a plurality of fins extending from said tubes into said air inlet means and toward said air outlet means.

18. The construction according to claim 16 including adjustable damper means associated with said air inlet means and air outlet means.

* * * * *